US007913490B2

(12) United States Patent
Koo et al.

(10) Patent No.: US 7,913,490 B2
(45) Date of Patent: Mar. 29, 2011

(54) HYDRAULIC CIRCUIT FOR CONSTRUCTION MACHINE

(75) Inventors: Bon Seok Koo, Kyungsangnam-do (KR); Man Suk Jeon, Kyungsangnam-do (KR)

(73) Assignee: Volvo Construction Equipment Hold Sweden AB, Eskilstuna (SE)

( * ) Notice: Subject to any disclaimer, the term of this patent is extended or adjusted under 35 U.S.C. 154(b) by 402 days.

(21) Appl. No.: 12/075,038

(22) Filed: Mar. 7, 2008

(65) Prior Publication Data

US 2008/0223027 A1 Sep. 18, 2008

(30) Foreign Application Priority Data

Mar. 12, 2007 (KR) ..... 10-2007-0024030

(51) Int. Cl.
*F15B 11/16* (2006.01)
*E02F 9/22* (2006.01)

(52) U.S. Cl. ..... 60/422; 60/486

(58) Field of Classification Search ..... 60/421, 60/422, 484, 486
See application file for complete search history.

(56) References Cited

U.S. PATENT DOCUMENTS

| | | | | |
|---|---|---|---|---|
| 5,083,428 | A * | 1/1992 | Kubomoto et al. | 60/486 |
| 6,330,797 | B1 * | 12/2001 | Kondo | 60/486 |
| 6,799,424 | B2 * | 10/2004 | Ioku et al. | 60/484 |
| 2004/0123499 | A1 * | 7/2004 | Arii | 37/348 |
| 2004/0154294 | A1 * | 8/2004 | Jeon | 60/428 |

* cited by examiner

*Primary Examiner* — Thomas E Lazo
(74) *Attorney, Agent, or Firm* — Ladas & Parry LLP

(57) ABSTRACT

A hydraulic circuit for a construction machine is disclosed, which can prevent an energy loss of a hydraulic system by automatically reducing revolution of an engine when a working device such as a boom is not driven. The hydraulic circuit includes first to third hydraulic pumps, first to third switching valves for controlling hydraulic fluid fed to working devices, a fourth switching valve for controlling hydraulic fluid fed to left and right traveling devices, a confluence switching valve for selectively supply the hydraulic fluid from the third hydraulic pump to either the working devices on the first hydraulic pump side or the working devices on the second hydraulic pump side, a signal line for traveling devices, signal lines for working devices, and a shuttle valve for selecting any one of the signal pressure formed in the signal line for the traveling devices and the signal pressure formed in the signal lines for the working devices.

3 Claims, 3 Drawing Sheets

HYDRAULIC CIRCUIT FOR CONSTRUCTION MACHINE

CROSS-REFERENCE TO RELATED APPLICATION

This application is based on and claims priority from Korean Patent Application No. 10-2007-24030, filed on Mar. 12, 2007 in the Korean Intellectual Property Office, the disclosure of which is incorporated herein in its entirety by reference.

BACKGROUND OF THE INVENTION

1. Field of the Invention

The present invention relates to a hydraulic circuit for a construction machine, which can implement an auto idle function by automatically reducing revolution of an engine when a working device of the construction machine such as an excavator is not driven.

More particularly, the present invention relates to a hydraulic circuit for a construction machine, which can minimize an energy loss of a hydraulic system by automatically reducing revolution of an engine when a working device such as a boom is not driven.

Hereinafter, in the accompanying drawings, only the construction of pilot signal lines related to an auto idle function is illustrated. When corresponding switching valves are switched over, the pilot signal lines are intercepted. The spool switching state of the switching valves and flow paths formed between the switching valves and working devices are not separately illustrated.

2. Description of the Prior Art

Referring to FIG. 1, a conventional hydraulic circuit for a construction machine having an auto idle function includes first to third hydraulic pumps P1, P2, and P3; a first switching valve A composed of valves installed in a flow path of the first hydraulic pump P1 and shifted to control hydraulic fluid fed to working devices, such as arm, boom, bucket, and the like; a second switching valve B composed of valves installed in a flow path of the second hydraulic pump P2 and shifted to control hydraulic fluid fed to working devices, such as arm, boom, option device, and the like; a third switching valve C composed of valves installed in a flow path of the third hydraulic pump P3 and shifted to control hydraulic fluid fed to a swing device and so on; a fourth switching valve D composed of valves installed on upstream sides of the flow paths of the first and second hydraulic pumps P1 and P2, respectively, and shifted to control hydraulic fluid fed to left and right traveling devices; and a confluence switching valve 8 installed on a downstream side of the flow path of the third hydraulic pump P3 and shifted to selectively supply the hydraulic fluid from the third hydraulic pump P3 to the working devices on the first hydraulic pump side P1 or the working devices on the second hydraulic pump side P2, in response to a pilot signal pressure Pi1 applied thereto.

In a small-sized excavator, the hydraulic fluid fed from the first hydraulic pump P1 is supplied to a right traveling motor and the hydraulic fluid fed from the second hydraulic pump P2 is supplied to a left traveling motor to drive the traveling motors. In the case of driving other working devices such as boom and so on, the confluence switching valve 8 is used to supply the hydraulic fluid fed from the third hydraulic pump P3 to the working devices.

The confluence switching valve 8 is shifted, in response to the pilot signal pressure Pi1 being supplied from a pilot pump to a signal line 3, to supply the hydraulic fluid fed from the third hydraulic pump P3 to the working devices on the first hydraulic pump side P1 or to the working devices on the second hydraulic pump side P2.

A signal line 4 connected to a signal line 3 includes a signal line 5 passing through the first and second switching valves A and B for the working devices and a signal line 6 passing through the fourth switching valve D for traveling devices. In the case where only either the first and second switching valves A and B or the fourth switching valve D is shifted to operate, no signal pressure is formed in the signal line 3.

In the case where the first and second switching valves A and B for the working devices and the fourth switching valve D for the traveling devices are simultaneously shifted to operate, the confluence switching valve 8 is shifted in response to the pilot signal pressure Pi1 formed in the signal line 3. Accordingly, the hydraulic fluid fed from the third hydraulic pump P3 is supplied to the working devices of the first hydraulic pump side P1 or the working devices of the second hydraulic pump side P2.

In the case of simultaneously implementing the above-described confluence function and the auto idle function, it is required to separately provide a signal line that can detect the shifting of the first and second switching valves A and B and the fourth switching valve D.

That is, if either the first and second switching valves A and B or the fourth switching valve D is shifted, no signal pressure is formed in the signal line 3. Accordingly, the pressure in the signal line 3 cannot be used as an auto idle signal pressure.

Accordingly, in the case of shifting the first and second switching valves A and B or the fourth switching valve D, a separate signal line 7 that can detect the shifting is required. The signal line 7 is connected to the signal line 3, and is connected to a flow path in which a second throttling part 2 is installed. In addition, the signal line 7 is constructed to pass through the first to third switching valves A, B, and C for the working devices and the fourth switching valve D for the traveling devices.

In a neutral state of the first to fourth switching valves A, B, C, and D, no signal pressure is formed in the signal line 7. Accordingly, it is judged that the working devices do not operate, and thus the engine revolution of the equipment is automatically reduced.

In the case of shifting any one of the first to fourth switching valves A, B, C, and D, the signal pressure is formed in the signal line 7, and thus the engine revolution can be accelerated by the signal pressure.

Referring to FIG. 2, another conventional hydraulic circuit for a construction machine having an auto idle function includes a confluence switching valve 8 shifted by a signal pressure Pi1 fed from a pilot pump (not illustrated) to a signal line 13 to supply hydraulic fluid fed from a third hydraulic pump P3 to working devices on a first hydraulic pump side P1 or working device on a second hydraulic pump P2; a signal line 16 which is connected to the signal line 13 and in which a signal pressure is formed when a fourth switching valve D for traveling devices is shifted; a signal line 15 which is connected to a signal line 16 and in which a signal pressure is formed when first and second switching valves A and B for working devices are shifted; and a signal line 17 in which a fourth throttling part 12 is installed, which is connected to a signal line to which a pilot signal pressure Pi2 is supplied, and in which a signal pressure is formed when the first to third switching valves A, B, and C for the working devices and the fourth switching valve D for the traveling devices are shifted.

The conventional hydraulic circuit of FIG. 2 further includes first to third hydraulic pumps P1, P2, and P3; a first switching valve A installed in a flow path of the first hydraulic pump P1; a second switching valve B installed in a flow path of the second hydraulic pump P2; and a third switching valve C installed in a flow path of the third hydraulic pump P3. However, since these constituent elements are substantially the same as those of the circuit as illustrated in FIG. 1, the detailed description thereof will be omitted. The same drawing reference numerals are used for the same elements across various figures.

As illustrated in FIGS. 1 and 2, the conventional hydraulic circuits having an auto idle function requires a confluence circuit including the confluence switching valve 8 and separate auto idle signal lines 7 and 17, and this causes the construction of the signal lines to be complicated. Particularly, the hydraulic circuit as illustrated in FIG. 2 has very complicated signal lines.

In addition, since the signal lines 7 and 17 pass through spools of the first to third switching valve A, B, and C for the working devices and the fourth switching valve D for the traveling devices, the hydraulic fluid may leak through joint surfaces of the first to fourth switching valves A, B, C, and D. Particularly, in a high-temperature working environment, the formed auto-idle pressure may become unstable due to the leakage of the hydraulic fluid.

SUMMARY OF THE INVENTION

Accordingly, the present invention has been made to solve the above-mentioned problems occurring in the prior art while advantages achieved by the prior art are maintained intact.

One object of the present invention is to provide a hydraulic circuit for a construction machine, which can simplify the construction of signal lines in a hydraulic circuit having a confluence circuit and auto idle signal lines.

Another object of the present invention is to provide a hydraulic circuit for a construction machine, which can stably maintain the formed auto-idle pressure by minimizing the leakage of hydraulic fluid through joint surfaces of switching valves for working devices and traveling devices.

In order to accomplish these objects, there is provided a hydraulic circuit for a construction machine, according to an embodiment of the present invention, which includes first to third hydraulic pumps; a first switching valve composed of valves installed in a flow path of the first hydraulic pump and shifted to control hydraulic fluid fed to working devices; a second switching valve composed of valves installed in a flow path of the second hydraulic pump and shifted to control hydraulic fluid fed to working devices; a third switching valve composed of valves installed in a flow path of the third hydraulic pump and shifted to control hydraulic fluid fed to working devices; a fourth switching valve composed of valves installed on upstream sides of the flow paths of the first and second hydraulic pumps, respectively, and shifted to control hydraulic fluid fed to left and right traveling devices; a confluence switching valve installed on a downstream side of the flow path of the third hydraulic pump and shifted by a signal pressure fed to a signal line to selectively supply the hydraulic fluid from the third hydraulic pump to either the working devices on the first hydraulic pump side or the working devices on the second hydraulic pump side; a signal line for traveling devices which is connected to the signal line for the confluence switching valve and in which a signal pressure is formed when the fourth switching valve is shifted; signal lines for working devices which are connected to the signal line for the confluence switching valve and in which a signal pressure is formed when any one of the first to third switching valves is shifted; and a shuttle valve, installed at an intersection of a flow path that is connected to a signal line connected to the signal line for the traveling devices and the signal line for the confluence switching valve and a flow path that is branched and connected to the signal line for the confluence switching valve and the signal line for the working devices, for selecting any one of the signal pressure formed in the signal line for the traveling devices and the signal pressure formed in the signal lines for the working devices.

The hydraulic circuit for a construction machine according to an embodiment of the present invention may further include a signal pressure output port installed in the signal line for the traveling devices so that the signal pressure formed in the signal line for the traveling devices can be used as the signal pressure for travel boosting or travel alarming.

The hydraulic circuit for a construction machine according to an embodiment of the present invention may further include a check valve installed in a signal line branched and connected to the signal line for the traveling devices and the signal line for the confluence switching valve so that the signal pressure is formed in the signal line for the traveling devices when the fourth switching valve is shifted.

The hydraulic circuit for a construction machine according to an embodiment of the present invention may further include a check valve installed in a flow path connected to the signal line for the confluence switching valve and the signal line for working devices so that the signal pressure is formed in the signal line for working devices when either of the first and second switching valves is shifted.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 3:
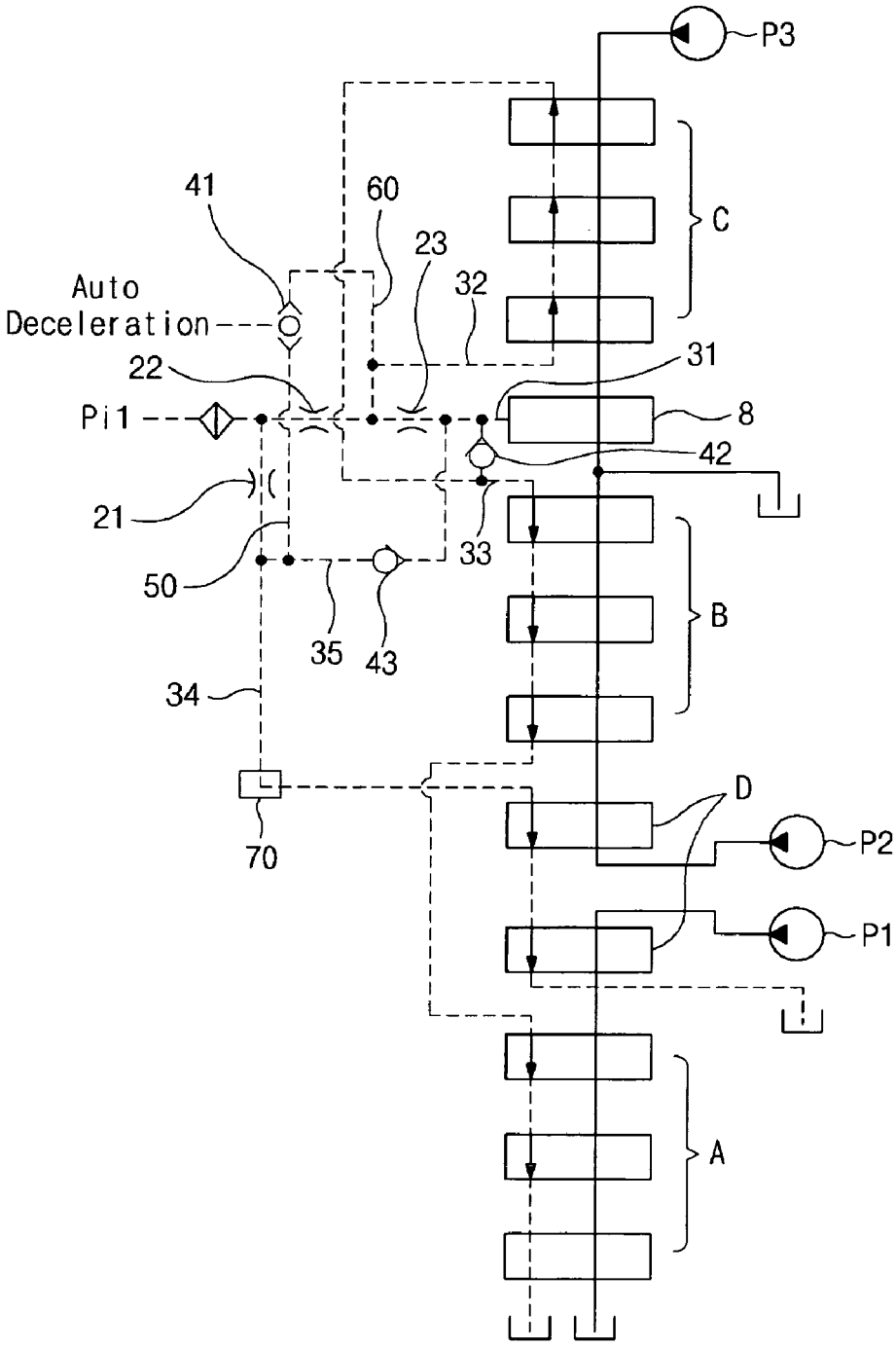
FIG. 3 is a circuit diagram of a hydraulic circuit for a construction machine having an auto idle function according to an embodiment of the present invention.

FIG. 3 is a circuit diagram of a hydraulic circuit for a construction machine having an auto idle function according to an embodiment of the present invention.

Referring to FIG. 3, the hydraulic circuit for a construction machine according to an embodiment of the present invention includes first to third hydraulic pumps P1, P2, and P3; a first switching valve A composed of valves installed in a flow path of the first hydraulic pump P1 and shifted to control hydraulic fluid fed to working devices such as arm, boom, bucket, and the like; a second switching valve B composed of valves installed in a flow path of the second hydraulic pump P2 and shifted to control hydraulic fluid fed to working devices such as arm, boom, option device, and the like; a third switching valve C composed of valves installed in a flow path of the third hydraulic pump P3 and shifted to control hydraulic fluid fed to working devices such as swing device and the like; a fourth switching valve D composed of valves installed on upstream sides of the flow paths of the first and second hydraulic pumps P1 and P2, respectively, and shifted to control hydraulic fluid fed to left and right traveling devices; a confluence switching valve 8 installed on a downstream side of the flow path of the third hydraulic pump P3 and shifted by a signal pressure Pi1 fed to a signal line 31 to selectively supply the hydraulic fluid from the third hydraulic pump P3 to either the working devices on the first hydraulic pump side P1 or the working devices on the second hydraulic pump side P2; a signal line 34 for traveling devices which is connected to the signal line 31 for the confluence switching valve and in which a signal pressure is formed when the fourth switching valve D is shifted; signal lines 32 and 33 for working devices which are connected to the signal line 31 for the confluence switching valve and in which a signal pressure is formed when any one of the first to third switching valves A, B, and C is shifted; and a shuttle valve 41, installed at an intersection of a flow path 50 that is connected to a signal line 35 connected to the signal line 34 for the traveling devices and the signal line 31 for the confluence switching valve and a flow path 60 that is branched and connected to the signal line 31 for the confluence switching valve and the signal line 32 for the working devices, for selecting any one of the signal pressure formed in the signal line 34 for the traveling devices and the signal pressure formed in the signal lines 32 and 34 for the working devices.

The hydraulic circuit for a construction machine according to an embodiment of the present invention may further include a signal pressure output port 70 installed in the signal line 34 for the traveling devices so that the signal pressure formed in the signal line 34 for the traveling devices can be used as the signal pressure for travel boosting or travel alarming.

The hydraulic circuit for a construction machine according to an embodiment of the present invention may further include a check valve 43 installed in a signal line 35 branched and connected to the signal line 34 for the traveling devices and the signal line 31 for the confluence switching valve so that the signal pressure is formed in the signal line 34 for the traveling devices when the fourth switching valve D is shifted.

The hydraulic circuit for a construction machine according to an embodiment of the present invention may further include a check valve 42 installed in a flow path connected to the signal line 31 for the confluence switching valve and the signal line 33 for working devices so that the signal pressure is formed in the signal line 33 for working devices when either of the first and second switching valves A and B is shifted.

Second and third throttling parts 22 and 23 are installed in the signal line 31 for the confluence switching valve.

The signal line 34 for the traveling devices is connected to an upstream side of the second throttling part 22 installed in the signal line 31 for the confluence switching valve, and the signal pressure is supplied to a spool of the fourth switching valve D through a first throttling part 21.

The signal lines 32 and 33 for the working devices are connected to the signal line 31 for the confluence switching valve interposed between the second and third throttling parts 22 and 23. The signal pressure is supplied to a spool of the third switching valve C through the second throttling part 22 and the signal line 32, and then is supplied to the second switching valve B and the first switching valve A along the signal line 33.

Figure 1:
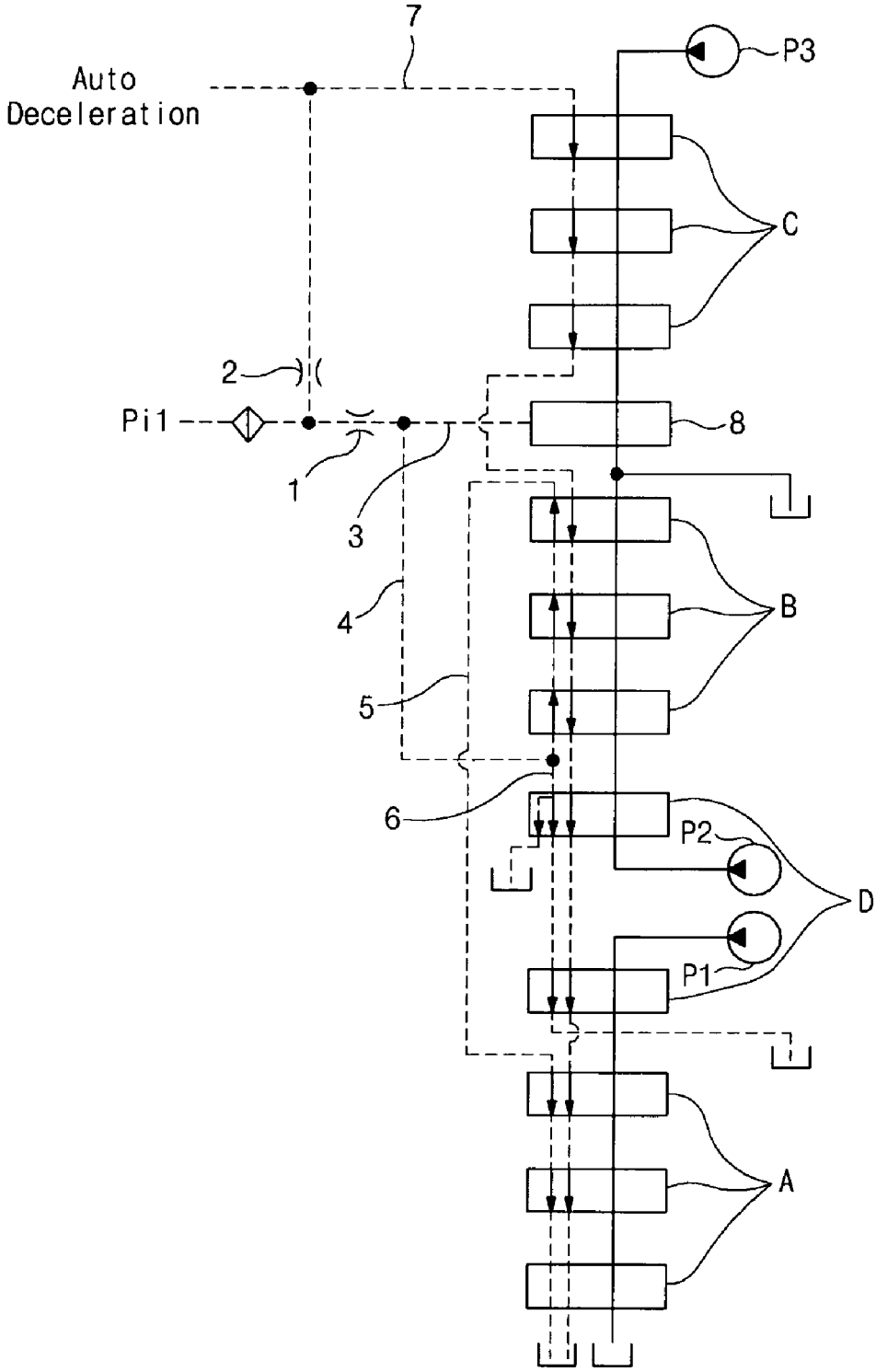
Fig. 1 Prior Art
FIG. 1 is a circuit diagram of a conventional hydraulic circuit having an auto idle function.
Figure 2:
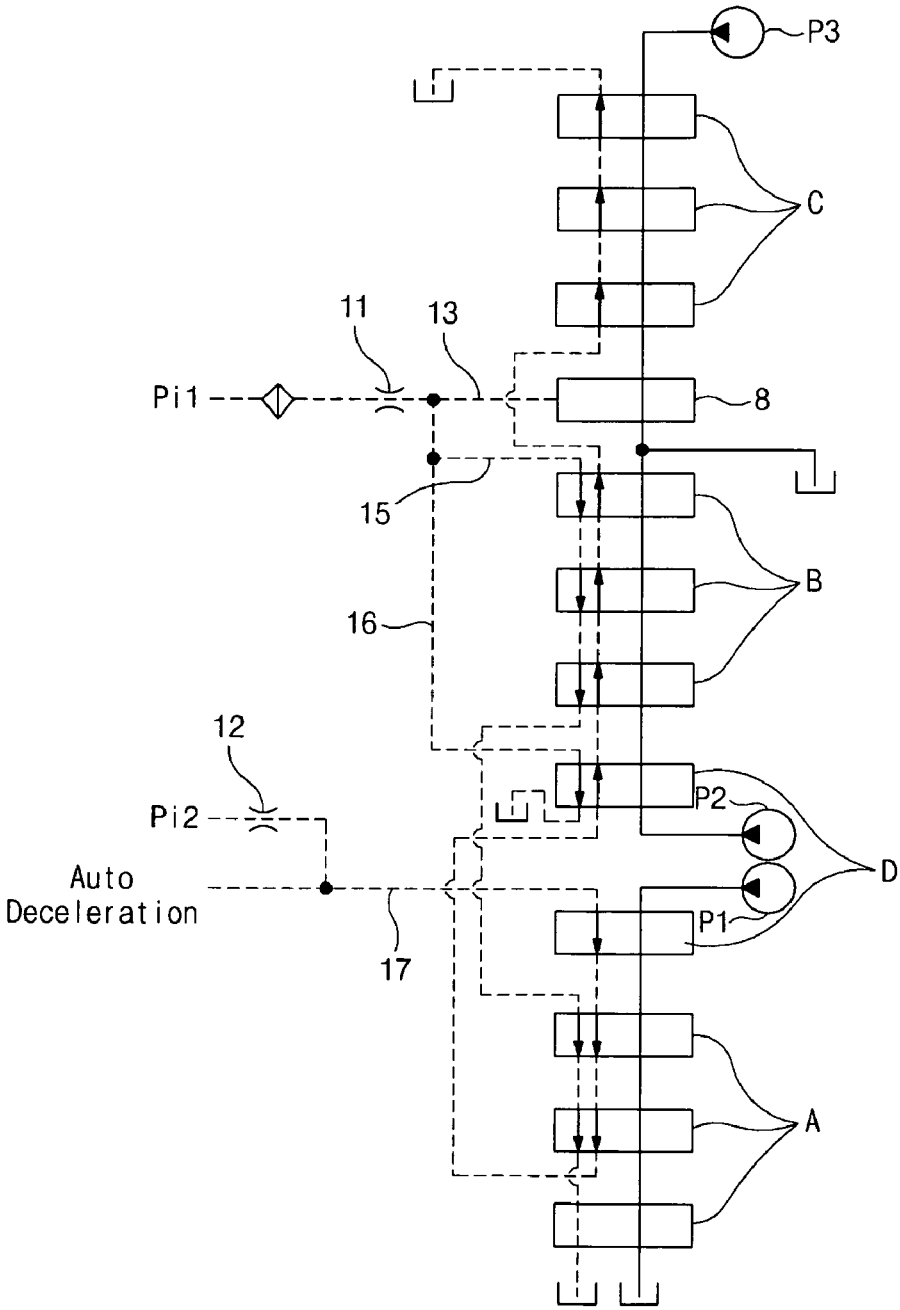
Fig. 2 Prior Art
FIG. 2 is a circuit diagram of another conventional hydraulic circuit having an auto idle function.

The hydraulic circuit, which includes the first to third hydraulic pumps P1, P2, and P3, the first switching valve A installed in the flow path of the first hydraulic pump P1, the second switching valve B installed in the flow path of the second hydraulic pump P2, the third switching valve C installed in the flow path of the third hydraulic pump P3, the fourth switching valve D installed in the flow path of the first and second hydraulic pumps P1 and P2, and the confluence switching valve 8 installed on the downstream side of the flow path of the third hydraulic pump P3, is substantially the same as the hydraulic circuit as illustrated in FIG. 1, and thus the detailed description thereof will be omitted. The same drawing reference numerals are used for the same elements across various figures.

Hereinafter, the operation of the hydraulic circuit for a construction machine according to an embodiment of the present invention will be described with reference to the accompanying drawings.

As illustrated in FIG. 3, the hydraulic fluid fed from the first hydraulic pump P1 is supplied to the right traveling motor and the hydraulic fluid fed from the second hydraulic pump P2 is supplied to the left traveling motor to drive the traveling motors. In the case of driving the working devices such as arm and so on, the confluence switching valve 8 is used to supply the hydraulic fluid fed from the third hydraulic pump P3 to the working devices.

The confluence switching valve 8 is shifted, in response to the pilot signal pressure Pi1 applied thereto through the second and third throttling parts 22 and 23 installed in the signal line 31 for the confluence switching valve. When the confluence switching valve 8 is shifted, the hydraulic fluid fed from the third hydraulic pump P3 is supplied to either the working devices on the first hydraulic pump side P1 or the working devices on the second hydraulic pump side P2.

In the case of shifting the fourth switching valve D for the traveling devices, a signal pressure is formed in the signal line 34 for the traveling devices by the check valve 43 installed in the signal line 35. Accordingly, it is possible to use the signal pressure for implementing an auto idle function through the shuttle valve 41 installed in the flow path 50 branched and connected to the signal line 34.

In the case of shifting the third switching valve C connected to the third hydraulic pump P3, a signal pressure is formed in the signal line 32 by the third throttling part 23. Accordingly, it is possible to use the signal pressure for implementing an auto idle function through the shuttle valve 41 installed in the flow path 60 branched and connected to the signal line 32.

The signal line 31 for the confluence switching valve is connected to the signal line 33 for the working devices through the check valve 42. That is, in the case where the first switching valve A or the second switching valve B is not shifted, no signal pressure is formed in the signal line 31. In this case, the confluence switching valve 8 is not shifted.

In the case of shifting the first switching valve A or the second switching valve B, a signal pressure is formed in the signal lines 32 and 33. Accordingly, it is possible to use the signal pressure for implementing an auto idle function through the shuttle valve 41 installed in the flow path 60 branched and connected to the signal line 32.

The signal line 35 connected to the signal line 31 for the confluence switching valve is connected to the signal line 34 for the traveling devices. If the fourth switching valve D is not shifted, no signal pressure is formed in the signal line 31. In this case, the confluence switching valve 8 is not shifted.

On the other hand, in the case of simultaneously shifting the fourth switching valve D for the traveling devices and the first and second switching valves A and B for the working devices, the signal pressure is formed in the signal line 31 and in the signal lines 32, 33, and 34, and thus the confluence switching valve 8 is shifted.

Accordingly, the hydraulic fluid fed from the third hydraulic pump P3 is supplied to the working devices on the first hydraulic pump side P1 or to the working devices on the second hydraulic pump side P2 to drive the working devices.

In the case of shifting the first to third switching valves A, B, and C connected to the first to third hydraulic pumps P1, P2, and P3, respectively, the signal pressure for implementing the auto idle function can be secured.

That is, in the case of simultaneously shifting the fourth switching valve D for the traveling devices and the first and second switching valves A and B for the working devices, the confluence switching valve 8 is shifted by the signal pressure formed in the signal line 31. Accordingly, signal lines are formed so that the hydraulic fluid on the third hydraulic pump side P3 joins the working devices on the first and second hydraulic pumps P1 and P2.

As described above, in the case of implementing the confluence circuit and auto idle function in the hydraulic circuit for a construction machine according to an embodiment of the present invention, it is not necessary to form a separate signal line for passing through the first to third switching valves A, B, and C for all the working devices corresponding to the first to third hydraulic pumps P1, P2, and P3*a* in order to form the auto idle signal pressure line.

In other words, the signal line 32 passing through the third switching valve C for the working devices is connected to the signal line 33 passing through the first and second switching valves A and B for the working devices.

In addition, the signal line 34 for the traveling devices that is connected to the fourth switching valve D for the traveling devices is independently formed. Accordingly, the signal pressure being outputted through the signal pressure output port 70 formed in the signal line 34 can be used as the signal pressure for travel boosting or travel alarming.

As described above, the hydraulic circuit for a construction machine according to the present invention has the following advantages.

The construction of the signal lines in the hydraulic circuit having the confluence circuit and the auto idle signal lines can be simplified and thus the manufacturing cost thereof can be reduced.

The leakage of the hydraulic fluid through the joint surfaces of the respective switching valves for the working devices and the traveling devices can be minimized, and thus the formed auto idle pressure can be stably maintained.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic circuit for a construction machine, comprising:

first to third hydraulic pumps;

a first switching valve composed of valves installed in a flow path of the first hydraulic pump and shifted to control hydraulic fluid fed to working devices;

a second switching valve composed of valves installed in a flow path of the second hydraulic pump and shifted to control hydraulic fluid fed to working devices;

a third switching valve composed of valves installed in a flow path of the third hydraulic pump and shifted to control hydraulic fluid fed to working devices;

a fourth switching valve composed of valves installed on upstream sides of the flow paths of the first and second hydraulic pumps, respectively, and shifted to control hydraulic fluid fed to left and right traveling devices;

a confluence switching valve installed on a downstream side of the flow path of the third hydraulic pump and shifted by a signal pressure fed to a signal line to selectively supply the hydraulic fluid from the third hydraulic pump to either the working devices on the first hydraulic pump side or the working devices on the second hydraulic pump side;

a signal line for traveling devices which is connected to the signal line for the confluence switching valve and in which a signal pressure is formed when the fourth switching valve is shifted;

signal lines for working devices which are connected to the signal line for the confluence switching valve and in which a signal pressure is formed when any one of the first to third switching valves is shifted;

a shuttle valve, installed at an intersection of a flow path that is connected to a signal line connected to the signal line for the traveling devices and the signal line for the confluence switching valve and a flow path that is branched and connected to the signal line for the confluence switching valve and the signal line for the working devices, for selecting any one of the signal pressure formed in the signal line for the traveling devices and the signal pressure formed in the signal lines for the working devices; and a signal pressure output port installed in the signal line for the traveling devices so that the signal pressure formed in the signal line for the traveling devices can be used as the signal pressure for travel boosting or travel alarming.

2. The hydraulic circuit of claim 1, further comprising a check valve installed in a signal line branched and connected to the signal line for the traveling devices and the signal line for the confluence switching valve so that the signal pressure is formed in the signal line for the traveling devices when the fourth switching valve is shifted.

3. The hydraulic circuit of claim 1, further comprising a check valve installed in a flow path connected to the signal line for the confluence switching valve and the signal line for working devices so that the signal pressure is formed in the signal line for working devices when either of the first and second switching valves is shifted.

* * * * *